US008292750B2

(12) United States Patent
Gregorian

(10) Patent No.: US 8,292,750 B2
(45) Date of Patent: Oct. 23, 2012

(54) MOTION APPARATUS FOR USE WITH INFANT CARRIER

(76) Inventor: Sarah B. Gregorian, Natick, MA (US)

( * ) Notice: Subject to any disclaimer, the term of this patent is extended or adjusted under 35 U.S.C. 154(b) by 0 days.

(21) Appl. No.: 12/221,321

(22) Filed: Aug. 1, 2008

(65) Prior Publication Data

US 2009/0029784 A1 Jan. 29, 2009

Related U.S. Application Data

(63) Continuation of application No. 11/045,433, filed on Jan. 26, 2005, now Pat. No. 7,422,524.

(60) Provisional application No. 60/539,917, filed on Jan. 28, 2004.

(51) Int. Cl.
*A63G 9/16* (2006.01)
*A63G 9/12* (2006.01)

(52) U.S. Cl. ..... 472/119; 297/256.16

(58) Field of Classification Search ..... 472/118–125; 5/108, 109; 297/273, 274, 256.13, 256.14, 297/256.16

See application file for complete search history.

(56) References Cited

U.S. PATENT DOCUMENTS

| | | | | |
|---|---|---|---|---|
| 5,277,472 | A | 1/1994 | Freese et al. | |
| 5,463,381 | A | 10/1995 | Ryu et al. | |
| 5,464,381 | A | 11/1995 | Wilson | |
| 5,562,548 | A | 10/1996 | Pinch et al. | |
| 5,660,597 | A | 8/1997 | Fox et al. | |
| 5,803,817 | A | 9/1998 | Stern | |
| 5,833,545 | A | 11/1998 | Pinch et al. | |
| 6,209,892 | B1 | 4/2001 | Schaaf et al. | |
| 6,331,032 | B1 | 12/2001 | Haut et al. | |
| 6,520,862 | B1 | 2/2003 | Armbruster et al. | |
| 6,554,358 | B2 | 4/2003 | Kain | |
| 6,561,915 | B2 | 5/2003 | Kelly et al. | |
| 6,692,073 | B1 * | 2/2004 | Weathersby | 297/256.16 |
| 6,916,249 | B2 | 7/2005 | Meade | |
| 7,422,524 | B2 | 9/2008 | Gregorian | |
| 7,445,559 | B2 * | 11/2008 | Kakuda | 472/118 |
| 7,563,170 | B2 * | 7/2009 | Bellows et al. | 472/29 |
| 2002/0017769 | A1 | 2/2002 | Worth et al. | |
| 2003/0075903 | A1 | 4/2003 | Hsia | |

* cited by examiner

*Primary Examiner* — Kien Nguyen

(74) *Attorney, Agent, or Firm* — Jennifer A. Camacho; Greenberg Traurig, LLP

(57) ABSTRACT

A motion apparatus for use in combination with a standard infant carrier, such as a car seat. The motion apparatus comprises a support structure and a frame for receiving the transportable base of an infant car seat, and a drive assembly, which, when activated causes motion of the infant carrier. Methods and devices of the invention are useful to soothe an infant.

18 Claims, 6 Drawing Sheets

MOTION APPARATUS FOR USE WITH INFANT CARRIER

RELATED APPLICATION

This application is a continuation of U.S. patent application Ser. No. 11/045,433, entitled "Motion Apparatus for Use with Infant Carrier," filed Jan. 26, 2005; which claims the benefit of the filing date of U.S. Provisional Application Ser. No. 60/539,917, filed Jan. 28, 2004, titled "Motion Apparatus for Use with Infant Carrier," the entirety of which provisional application is incorporated by reference herein.

FIELD OF INVENTION

The present invention relates to infant-soothing devices. More particularly, the present invention relates to soothing-motion devices for use with standard infant carriers.

BACKGROUND

As anyone who has spent any amount of time with an infant knows, motion is a universal soother of a fussy or tired baby. A new parent instinctively sways side to side to calm his baby, and even the crankiest of little ones has been known to drift off into blissful (and alas, quiet) slumber when snuggled into a car seat and driven around the block. For the less vehicularly inclined parent, the current marketplace offers numerous baby swings, bouncers, vibrational devices and strollers, all of which depend on motion to soothe an infant.

With so many different motion devices available for soothing an infant, an infant's caregiver may have, in addition to an infant carrier for use in a car, a baby swing, a bouncer, a stroller, or any combination of such devices for use around the home. Universal strollers that accept a standard infant car seat, which allows a caregiver to move a sleeping baby from a car to a stroller without removing the baby from the car seat, are known (e.g., see U.S. Pat. No. 6,209,892, the disclosure of which is incorporated by reference herein). However, if the caregiver simply wishes to move a calm or sleeping baby from the car to a baby swing or to a bouncer (or vice versa), the caregiver necessarily must jostle the baby, likely disrupting the baby's good mood or sleep. For example, upon arriving home from an outing, a baby may be fast asleep in the car, but, as an experienced parent knows, the baby may awaken abruptly once the motion of the car has ceased. To allow the baby to continue his or her nap, the parent may wish to place the infant into the swing or bouncer, but the mere act of doing so may disturb and awaken the baby.

In another example, a parent may wish to soothe a baby prior to an outing, such as a car ride or a stroll around the park, but after soothing the baby in a swing or bouncer, the baby's good mood may be lost as the parent tries to remove the baby from the swing or bouncer. Accordingly, even with all of the motion soothing devices currently available, needs remain for improved methods and devices for soothing an infant without the unnecessary disruption inherent in transferring the infant from one soothing setting to another.

SUMMARY

In general, the present invention provides devices that are adapted to receive an infant carrier easily and securely and, when activated, to cause motion of the carrier to soothe the infant. Because the devices of the present invention can be used with any standard carrier, and are thus "universal," an infant can be placed in the device without needing to remove the infant from his or her carrier and, thus, without disrupting the infant's sleep or agreeable state of consciousness. Likewise, an infant who is sleeping or being calmed by a device of the present invention may be easily moved from the device and securely placed in a vehicle or stroller with minimal disruption.

According to one embodiment, a motion apparatus of the invention provides a support structure, and a frame that is attached to the support structure. The frame is sized and shaped for receiving an infant carrier. In another embodiment, the support structure is collapsible. In one aspect, the invention provides for the frame to be suspended from or hingedly attached to the support structure. In another aspect, the frame may be fixedly attached to the support structure. In yet another embodiment, the support structure and the frame are part of unitary foundation (i.e., different portions of a single structure).

In another embodiment, the device is for use with an infant carrier that is a transportable base of an infant car seat. According to another aspect, the apparatus also includes a fastening mechanism on the frame that, in use, secures the infant carrier to the frame. In one embodiment, the fastening mechanism comprises a tether and buckle. In yet another embodiment, the transportable base may comprise a latching mechanism for releasably engaging a complementary locking component on a fixed car seat base. For example, a latching mechanism may include a transverse slot on the transportable base and a catch that extends across the transverse slot for engaging a complementary locking component in a fixed car seat base. In this embodiment, the frame may comprise a locking component that is complementary to the latching mechanism of the transportable base.

In another embodiment, the frame may comprise a pair of elongate, generally parallel side sections and a pair of elongate, generally parallel crossbar members that transversely interconnect the side sections. According to this embodiment, one of the crossbar members is received by the transverse slot and releasably interengaged with the latching mechanism in the transportable base of the car seat, and the other crossbar member is interengagable by the transportable base to mount the car seat on said frame.

In another embodiment of the invention, in which the infant carrier comprises both a transportable base and fixed car seat base, the frame is sized and shaped for receiving the fixed car seat base portion of the infant carrier. In this embodiment, the fastening mechanism secures the fixed car seat base to the frame and the transportable base is secured within the fixed car seat base.

To cause motion of the frame and thereby to cause motion of the infant carrier, the apparatus further includes a drive assembly in communication with the support structure, the frame, the fastening mechanism, or any combination thereof. In one aspect, an apparatus of the invention further comprises an infant carrier, such as an infant car seat (with or without a transportable base).

In yet another embodiment, the drive assembly causes a motion that is a swinging, lateral, horizontal, vertical, rotational, or vibrational motion. In another embodiment, the drive assembly comprises a motor vehicular motion simulator that causes a vibrational motion that resembles the motion experienced while riding in a car. In one aspect, the drive assembly may comprise a rotational continuous looped belt that simulates motor vehicular motion. Such a belt may be smooth to produce a smooth "ride." Alternatively, such a belt may have a one or more bumps to produce a bouncy "ride" more consistent with the actual motion of a motor vehicle in everyday use. In another aspect, the drive assembly may comprise a selecting device for selecting between one mote ride sensations (i.e., for example, smooth, bouncy, accelerating, decelerating, etc., or any combination of sensations). In addition, the drive assembly may further comprise an incline and/or decline mechanism to simulate uphill or downhill motion.

According to another aspect, a drive assembly in accordance with the invention may be mechanically or electronically driven, or battery powered. According to one embodiment, a drive assembly may comprise an actuating material, such as a piezoelectric or piezoelectric material.

In another embodiment, an apparatus of the invention comprises a motion controller for activating the drive assembly. Such a motion controller may further comprise a timer, a velocity adjuster, a range adjuster or any combination of any of the foregoing.

A timer in accordance with the invention can include a stop function to deactivate the drive assembly at a predetermined point (such as at a specific time or after a certain amount of time has elapsed). The invention further contemplates the use of a timer comprising an interval mechanism in which the drive assembly is activated and deactivated at interval times.

A velocity adjuster in accordance with the invention may comprise a selection device for selecting a velocity setting amongst two or more settings or it may comprise a continuous selection device for any number of velocity settings. Further, in accordance with the invention, a velocity adjuster may comprise an automatic function to increase or decrease velocity automatically.

A range adjuster in accordance with the invention may comprise a selection device for selecting a range setting amongst two or more settings or it may comprise a continuous selection device for any number of range settings. Further, according to the invention, a range adjuster may comprise an automatic function to increase or decrease range automatically.

In still another embodiment, the invention provides for a musical or sound element, such as static, traffic or automobile-generated noise, noises in nature, rainstorm, ocean or recorded voices, etc.

In another embodiment, a motion apparatus in accordance with the invention comprises a support structure, a fastening mechanism in physical communication with the support structure, and a drive assembly in physical communication with the support structure. In this embodiment, when in use, the fastening mechanism secures the infant carrier to the support structure and, upon activation, said drive assembly causes motion of the infant carrier. In one aspect of this embodiment, the fastening mechanism comprises at least one closing latch that is capable of securely but releasably latching the carrying handle of the infant carrier.

Other objects, advantages, and features of the present invention will become apparent upon reading, with reference to the accompanying drawings, the following non restrictive description of the embodiments thereof.

BRIEF DESCRIPTION OF THE DRAWINGS

The respective drawn figures schematically illustrate certain embodiments of the invention, and are intended solely as an aid to understanding of the various exemplary embodiments depicted.

DETAILED DESCRIPTION

Disclosed herein are novel methods and devices for soothing an infant. Such methods and devices are well suited for incorporation into the busy and mobile lifestyle of today's parents. The devices of the invention allow a caregiver to move a calm or sleeping infant easily, without ever having to take the infant out of the transportable base of the infant's carrier, and thereby not awakening or jostling the infant.

The invention provides motion-producing apparatuses that are for use in combination with an infant carrier. A type of infant carrier that is particularly useful in combination with the present invention is an infant car seat that comprises a fixed car seat base that, in use, remains secured to a seat in a motor vehicle and a transportable base that functions a seat for the infant and which is removable from the fixed car seat. Apparatuses of the invention are useful for calming or soothing an infant while the infant remains in the carrier. This important feature can provide far greater flexibility and mobility for the infant caregiver than any of the motion apparatuses available today. The apparatuses of the invention permit the caregiver to move an infant easily between the car and the home, between rooms in the house, or between the home and a universal stroller, by simply moving the infant to and from a motion apparatus of the invention while the infant remains comfortably secure in his or her car seat.

According to the present invention, a soothing device is provided that comprises a support structure, a frame sized and shaped for receiving an infant carrier, and a drive assembly for producing a motion. Because the nature of this soothing device is to produce a motion, the device relies upon the support structure to provide a secure footing on the underlying surface (i.e., a floor, table, chair, etc.). The support structure may take anyone of a variety of forms and be made of any number of materials so long as the support structure supports the combined weight of the frame, infant carrier and carrier; and provides a secure footing. Support structures contemplated by this invention include both up-right structures and low-profile structures. Exemplary materials include steel, aluminum, metal alloys, plastic resins, etc., and other structural building materials known in the art and used in support structures of, for example, traditional infant swings and infant bouncers.

Figure 1:
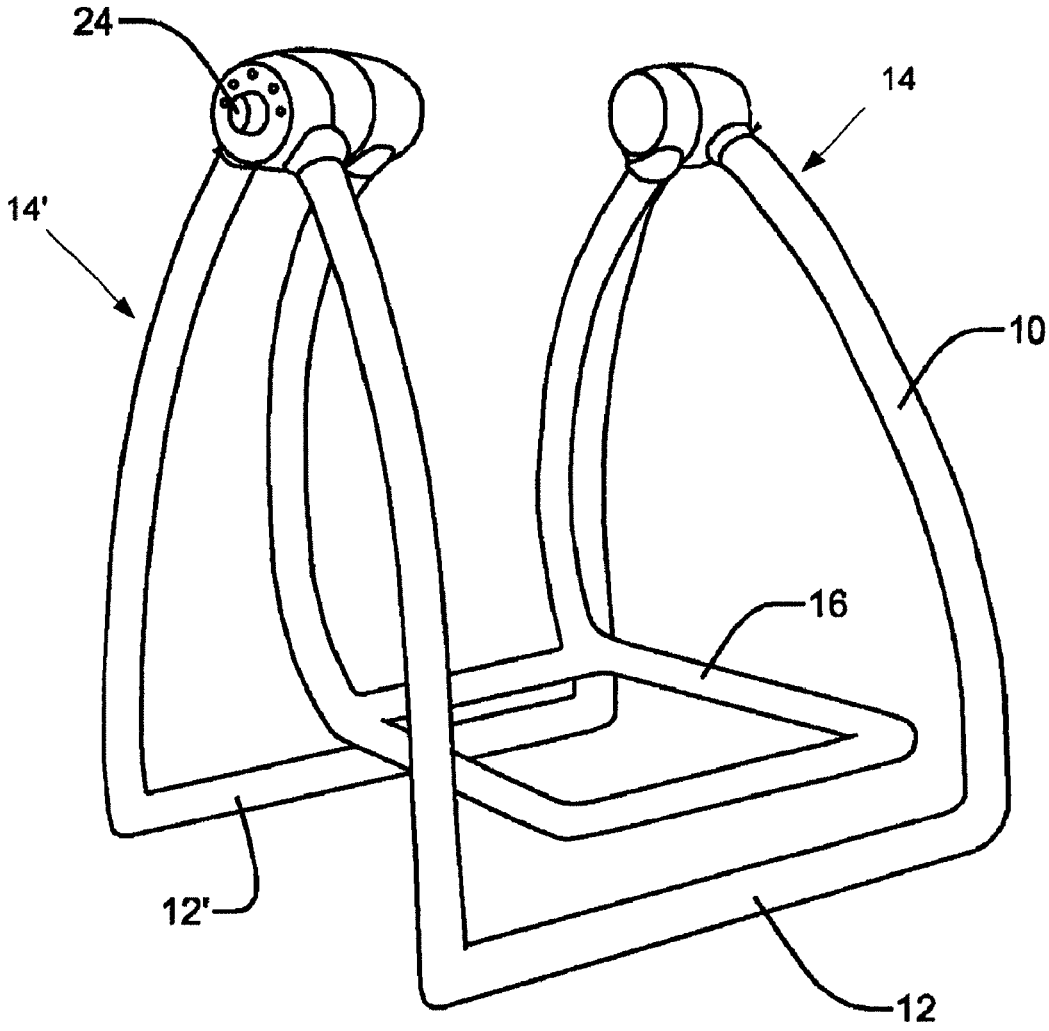
FIG. 1 shows one embodiment of the invention in which the frame is hingedly attached to the support structure.
Figure 2:
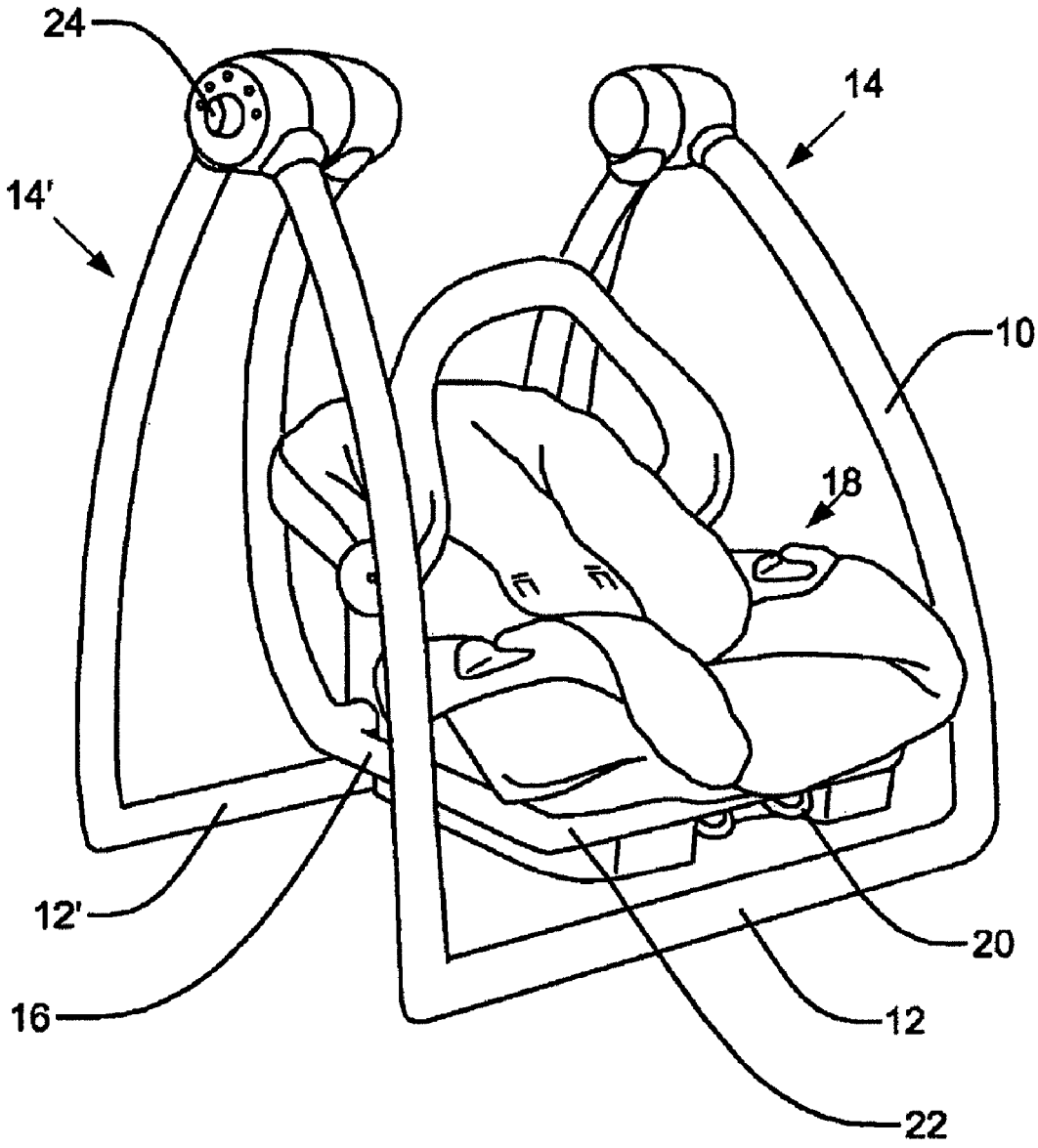
FIG. 2 shows the embodiment of FIG. 1 in use with a transportable base of an infant carrier mounted on the frame.

In a preferred up-right embodiment shown in FIGS. 1 and 2, the support structure 10 may have a generally double A-framed shape with crossbars 12, 12' contacting underlying surfaces and with apices 14, 14' hingedly connected to the frame 16. The embodiment shown is particularly useful with an infant carrier that is a transportable base of an infant car seat. In this embodiment, the transportable base may comprise a latching mechanism for releasably engaging a complementary locking component on fixed car seat base. For example, a latching mechanism may include a transverse slot on the transportable base and a latching mechanism that extends across the transverse slot for engaging a complementary locking component in a fixed car seat base. In this embodiment, the frame may comprise a locking component that is complementary to the latching mechanism of the transportable base.

As shown in use in FIG. 2, in use, the infant carrier 18 is placed in the frame 16. The frame 16 shown in FIG. 2 comprises a pair of elongate, generally parallel side sections and a pair of elongate, generally parallel crossbar members that transversely interconnect the side sections. In the embodiment shown, the infant carrier 18 includes a latching mechanism 20 that attaches to the fastening mechanism 22 of the frame 16. As shown in FIG. 2, the fastening mechanism 22 comprises a portion of the frame 16 that is a complementary locking component. More specifically, in this embodiment, one of the crossbar members of the frame 16 is received by the transverse slot and releasably interengaged with the latching mechanism in the transportable base of the car seat, and the other crossbar member is interengaged by the transportable base to mount the car seat on said frame. In general, the locking component of the frame need not be identical to that found on the fixed car seat base; any locking component that is complementary to, that is, able to engage securely (but releasably) the latching mechanism of the transportable base suffices. In use, the embodiment shown in FIGS. 1 and 2 functions as a swing upon activation of the drive assembly (not shown). More specifically, the frame 16 swings from the hinged attachment to the support structure. A motion controller 24 may control such motion.

Figure 3:
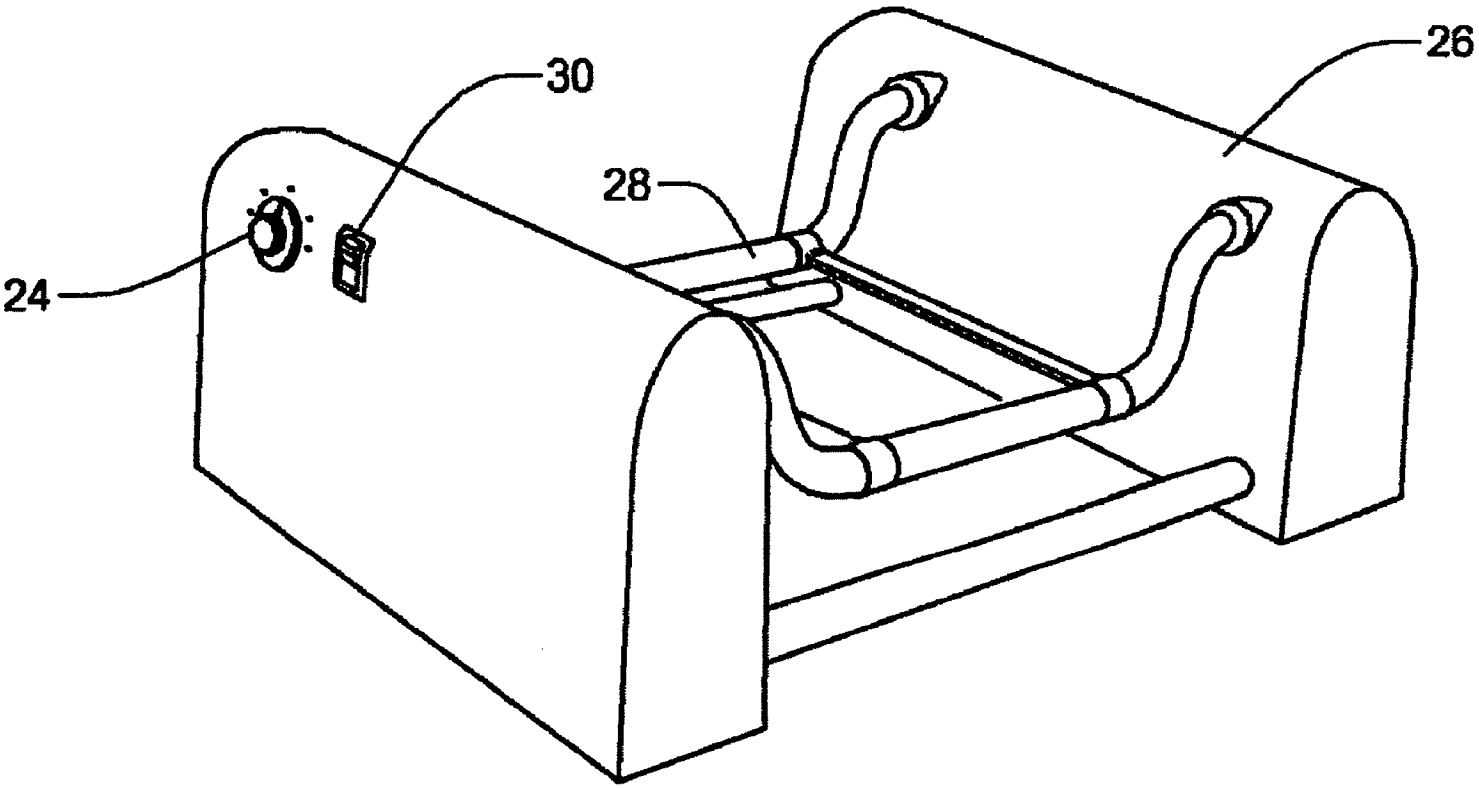
FIG. 3 shows another embodiment of the invention in which the frame is fixedly attached to the support structure.
Figure 4:
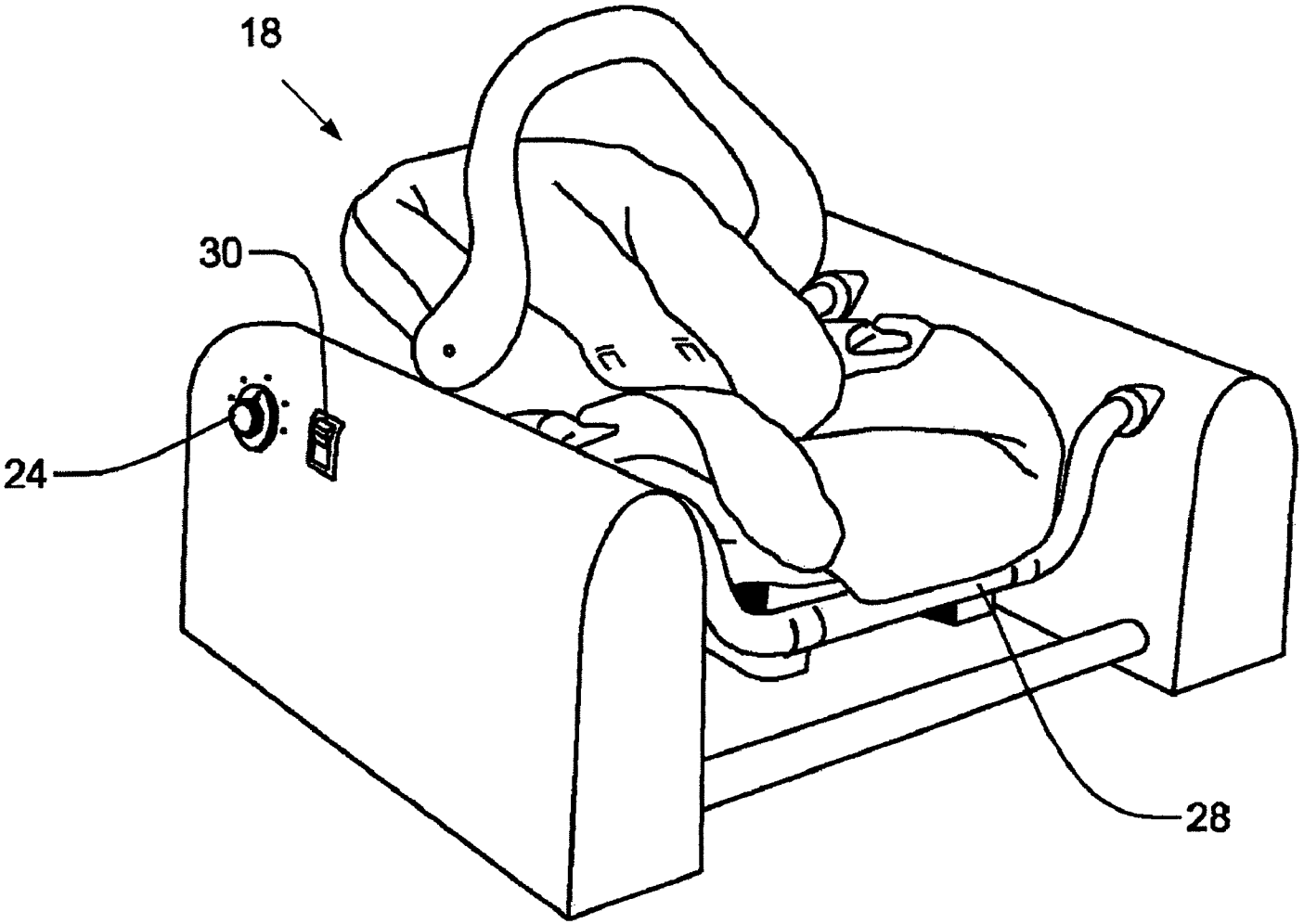
FIG. 4 shows the embodiment of FIG. 3 in use with a transportable base of an infant carrier mounted on the frame.

In the embodiment shown in FIGS. 3 and 4, the support structure 26 has a low profile. In this embodiment, a frame 28 is attached to the support structure 26, and the apparatus includes a toggle switch motion controller 30. The embodiment shown in FIGS. 3 and 4 is particularly well suited for a drive assembly that produces a vibrational or lateral motion. Such a drive assembly may comprise a gliding mechanism to produce a smooth lateral motion of upon activation.

Figure 6:
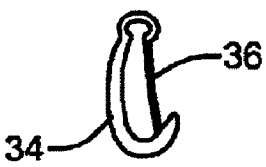
FIG. 6 shows an embodiment of a clamping latch useful in the invention.
Figure 5B:
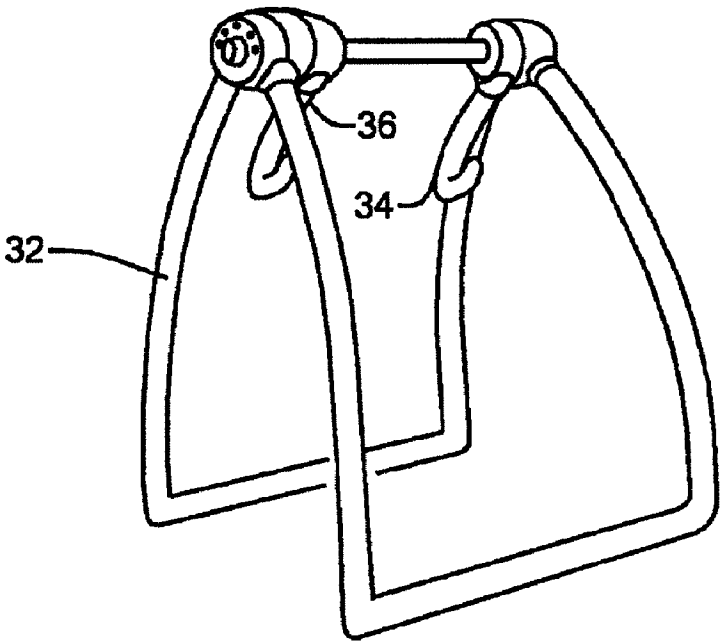
FIG. 5B shows the embodiment of support structure of FIG. 5A, without the infant carrier.
Figure 5A:
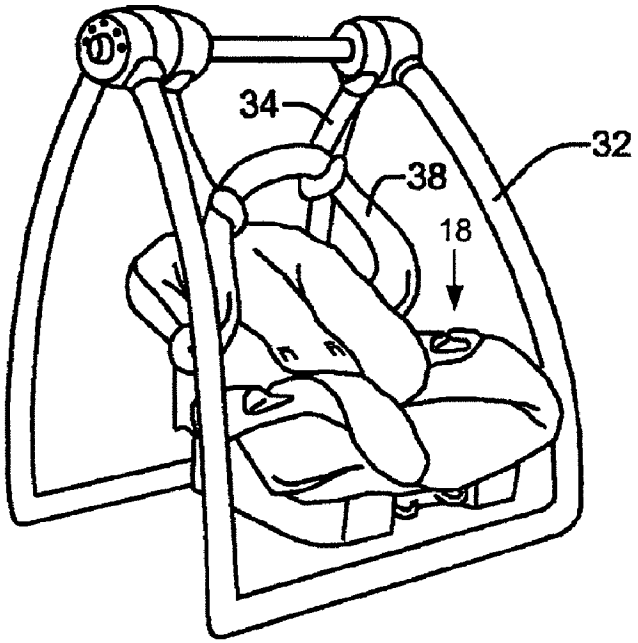
FIG. 5A shows yet another embodiment of the invention in which use of at least one closing latch secures the infant carrier to the support structure.

As shown in FIG. 5, an up-right embodiment of the invention may comprise a support structure 32 with a fastening mechanism 34 physically connected thereto. In use, as shown in FIG. 5, the carrying handle 38 of the infant carrier 14 is attached directly to the support structure 32 via the fastening mechanism 34. In one aspect of this embodiment, the fastening mechanism 34 comprises at least one closing latch capable of securely but releasably catching the carrying handle 38 of the infant carrier. An exemplary closing latch is shown in FIG. 6, which comprises a spring-loaded movable arm 36. To place the infant carrier on the motion apparatus shown in FIG. 6, the movable arm 36 of the closing latch is moved inward and the carrying handle 38 of the infant carrier 18 is placed inside the latch. The movable arm 36 is permitted to move outward in accordance with the spring-directed force.

While the support structure should be sturdy enough to support the combined weight of the frame, fastening mechanism, infant carrier, and infant, in one embodiment, the support structure and frame may be at least partially collapsible. For example, in an A-framed support structure, the apices may allow the support structure to be collapsed such that the legs move towards each other, permitting ease of storage. In addition, in one embodiment, the frame may also comprise a hinge allowing it to fold upward, further collapsing the device.

As discussed above, the frame may be hingedly or fixedly attached to the Support structure. In another embodiment, the frame may be suspended from one or more points on the support structure, thereby permitting a greater range of motion. In one embodiment, the caregiver may select from more than one direction of motion. For example, the caregiver may select side-to-side motion or front-to-back motion. Alternatively, a rotational motion may be selected, such as would be experienced on a swing dangling in the wind.

Figure 7:
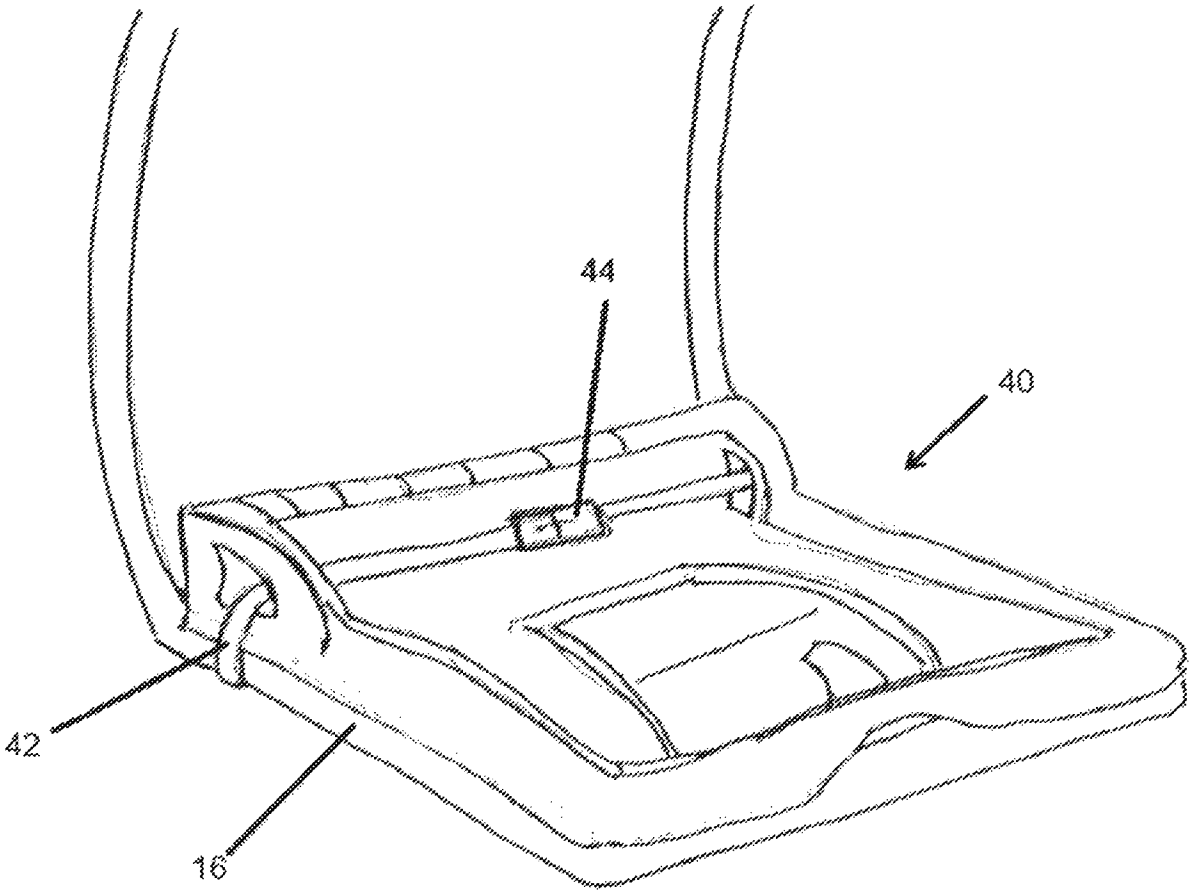
FIG. 7 shows an embodiment of the invention in use with a fixed car seat base of an infant carrier secured to a frame.

As shown in FIG. 7, another embodiment of a frame 16 according to the invention is sized and shaped to receive the fixed car seat base 40 of an infant carrier. A fastening mechanism particularly useful in this embodiment is a tether 42 and buckle 44, such as provided on a traditional automobile. In this embodiment, the fixed base 40 is secured to the frame 16 with the tether 42 and buckle 44 (in a manner similar as would be done in securing the fixed base 40 in an automobile). In this embodiment, the caregiver would be able to purchase an additional fixed car seat base for the infant carrier of choice, and install it on the frame rather than in an automobile. This embodiment is accordingly universal in that a device of the present invention can accommodate any type of infant carrier comprising a fixed base and a transportable base.

While the support structure and the frame are discussed as separate elements, it is important to note that the invention also contemplates a support structure and the frame that are part of unitary foundation (i.e., different portions of a single structure). For example, a hard plastic resin foundation may be molded into a support structure and frame.

To cause motion of the frame, and thereby cause motion of the infant carrier, the apparatus further includes a drive assembly in communication with the support structure, the frame, the fastening mechanism or any combination of any of the foregoing. As discussed above, the drive assembly may cause a swinging, lateral (or horizontal) and/or vibrational motion. Alternatively or in addition, the drive assembly may cause vertical, rotational or inclined/declined (i.e., such as is uphill or downhill) motion. According to another aspect, a drive assembly in accordance with the invention may be mechanically or electronically driven, or battery powered. In another embodiment, a drive assembly may comprise an actuating material, such as a piezoelectric or piezomagnetic material.

In another embodiment, the drive assembly may comprise a motor vehicular motion simulator that causes a vibrational motion that resembles the motion experienced while riding in a car. In one aspect, the drive assembly may comprise a rotational continuous looped belt that simulates motor vehicular motion. Such a belt may be smooth to produce a smooth "ride." Alternatively, such a belt may have a one or more bumps to produce a bouncy "ride" consistent with the true motion of a motor vehicle in everyday use. In another aspect, the drive assembly may comprise a selecting device for selecting between one more ride sensations (Le., for example, smooth, bouncy, accelerating, decelerating, etc., or any combination of sensations).

The invention further contemplates the use of one or more motion controllers, such as an activator, a timer, a velocity adjuster, a range adjuster or any combination of any of the foregoing. An exemplary timer may include a stop function to deactivate the drive assembly at a predetermined point (such as after a certain amount of time, or at a specific time). Such a stop function may be used in conjunction with a velocity adjuster such that, rather than stopping suddenly, the velocity begins a terminal deceleration that ultimately results in the complete cessation of motion. Further, the timer may comprise an interval mechanism in which the drive assembly is activated and deactivated at interval times.

Velocity adjusters in accordance with the invention may comprise a selection device for selecting a velocity setting amongst two or more settings, a continuous selection device for any number of velocity settings, or a random setting. Further, in accordance with the invention, a velocity adjuster may comprise an automatic function to increase or decrease velocity automatically (such as may be used in conjunction with a timer).

A range adjuster in accordance with the invention may comprise a selection device for selecting a range setting amongst two or more settings, a continuous selection device for any number of range settings, or a random setting. Further, according to the invention, a range adjuster may comprise an automatic function to increase or decrease range automatically.

In still another embodiment, the invention provides for a musical or sound element, such as static, traffic or automobile-generated noise, noises in nature, rainstorm, ocean or recorded voices, etc. This feature is particularly useful with a drive assembly that simulates motor vehicular motion to provide a more realistic simulation of automobile travel.

Drive assemblies and controllers for controlling motion, velocity, range and sound are known in the art, and any of the known drive assemblies and controllers in use with traditional infant swings, infant bouncers other soothing devices are useful in the present invention. For example, see U.S. Pat. Nos. 5,463,381; 5,660,597; 5,803,817, 6,520,862; 6,561,915, the disclosures of which are each incorporated by reference herein.

While the invention has been shown and described with reference to specific preferred embodiments, it should be understood by those skilled in the art that various changes in form and detail may be made therein without departing from the spirit and scope of the invention as defined by the following claims.

I claim:

1. A motion apparatus for use with an infant car seat, which car seat includes a transportable base having a latching mechanism for releasably engaging a complementary locking component in a fixed car seat base, said motion apparatus comprising:

(a) a transportable base of an infant car seat, said transportable base comprising a latching mechanism, and further comprising a carrying handle for moving an infant to and from the motion apparatus while the infant remains secured in the transportable base;

(b) a support structure;

(c) a frame attached to said support structure, said frame having the transportable base mounted thereon and comprising a locking component releasably engaged with the latching mechanism of said transportable base; thereby removably securing the transportable base to said frame; and (d) a drive assembly in physical communication with at least one of said support structure and said frame, said drive assembly causing motion of said frame upon activation.

2. The apparatus of claim 1, wherein said frame is hingedly attached to said support structure, and wherein said drive assembly causes a swinging motion in said frame.

3. The apparatus of claim 1, wherein said drive assembly causes a vibrational motion in said frame.

4. The apparatus of claim 1, wherein said drive assembly comprises a motor vehicular motion simulator.

5. The apparatus of claim 1, further comprising a motion controller for activating said drive assembly.

6. The apparatus of claim 5, wherein said motion controller comprises a timer.

7. The apparatus of claim 6, wherein said timer includes a stop function to deactivate the drive assembly at a predetermined point.

8. The apparatus of claim 5, wherein said motion controller comprises a velocity adjuster for determining the velocity of the motion.

9. The apparatus of claim 8, wherein said velocity adjuster comprises a selection device having at least two predetermined velocity settings.

10. The apparatus of claim 8, wherein said velocity adjuster comprises a continuous selection device.

11. The apparatus of claim 8, wherein said velocity adjuster comprises an automatic function to increase or decrease velocity automatically.

12. The apparatus of claim 5, wherein said motion controller comprises a range adjuster for determining the range of the motion.

13. The apparatus of claim 12, wherein said range adjuster comprises a selection device having at least two predetermined range settings.

14. The apparatus of claim 12, wherein said range adjuster comprises a continuous selection device.

15. The apparatus of claim 12, wherein said range adjuster comprises an automatic function to increase or decrease range automatically.

16. The apparatus of claim 1 further comprising a foundation, wherein said foundation comprises both of said support structure and said frame.

17. A motion apparatus for use with an infant car seat, said motion apparatus comprising:

(a) an infant car seat comprising (i) a transportable base having a carrying handle for moving a seated infant, and a latching mechanism, and (ii) a fixed car seat base having a locking component complementary to the latching mechanism of the transportable base, wherein, when the infant car seat is in use with an automobile, the fixed car seat base remains secured in the automobile and is releasably engaged with the transportable base, (b) a support structure;

(c) a frame attached to said support structure, said frame being sized and shaped for receiving the fixed base of the infant carrier;

(c) a fastening mechanism securing said fixed car seat base to said frame; and (d) a drive assembly in physical communication with at least one of said support structure and said frame, said drive assembly causing motion of said frame upon activation, wherein-said fixed car seat base is secured to said frame, and the locking component of the fixed base is releasably engaged with the latching mechanism of the transportable base, thereby securing the infant carrier to said frame.

18. The apparatus of claim 17, wherein said fastening mechanism comprises a tether and buckle.

* * * * *